US011890724B2

(12) United States Patent
Hofstee et al.

(10) Patent No.: US 11,890,724 B2
(45) Date of Patent: Feb. 6, 2024

(54) METHOD OF TREATING A WORKPIECE

(71) Applicants: Sander Hendrikus Johannes Hofstee, Werkik (BE); Jan Frederik Doddema, Paterswolde (NL)

(72) Inventors: Sander Hendrikus Johannes Hofstee, Werkik (BE); Jan Frederik Doddema, Paterswolde (NL)

(73) Assignee: MONTI-WERKZEUGE GMBH, Hennef (DE)

( * ) Notice: Subject to any disclaimer, the term of this patent is extended or adjusted under 35 U.S.C. 154(b) by 1125 days.

(21) Appl. No.: 16/677,883

(22) Filed: Nov. 8, 2019

(65) Prior Publication Data

US 2020/0147758 A1 May 14, 2020

(30) Foreign Application Priority Data

Nov. 12, 2018 (DE) ..... 102018128269.9

(51) Int. Cl.

| | |
|---|---|
| ***A46B 13/02*** | (2006.01) |
| ***B24D 13/02*** | (2006.01) |
| ***B24B 29/00*** | (2006.01) |
| ***B24B 1/04*** | (2006.01) |
| ***A46B 13/00*** | (2006.01) |

(52) U.S. Cl.

CPC ..... *B24D 13/02* (2013.01); *A46B 13/005* (2013.01); *B24B 1/04* (2013.01); *B24B 29/00* (2013.01); *B24B 29/005* (2013.01); *A46B 13/001* (2013.01); *A46B 2200/3093* (2013.01)

(58) Field of Classification Search

CPC ..... A46B 13/02; B24D 13/02; B24D 29/00; B24B 1/04

See application file for complete search history.

(56) References Cited

U.S. PATENT DOCUMENTS

| | | | | |
|---|---|---|---|---|
| 5,524,315 | A | 6/1996 | Montabaur | |
| 5,860,181 | A * | 1/1999 | Maekawa | B08B 1/007 15/21.1 |
| 9,554,642 | B2 | 1/2017 | Montabaur | |
| 9,918,544 | B2 | 3/2018 | Jannaschk | |

(Continued)

FOREIGN PATENT DOCUMENTS

| | | | |
|---|---|---|---|
| EP | 0585893 | A | 3/1994 |

OTHER PUBLICATIONS

AMEPA Surface Roughness Measurement; amepa.de. 2018.

*Primary Examiner* — Michael D Jennings
(74) *Attorney, Agent, or Firm* — Andrew Wilford

(57) ABSTRACT

A surface of a workpiece is treated by rotating about an axis a brush having a multiplicity of radially projecting bristles with tips engaging a surface of a workpiece to be treated while positioning a stop nonrotatable with the brush in engagement with the bristles radially inward of the stop so as to rearwardly deflect the bristles prior to contact with the workpiece and thereby store kinetic energy in the bristles so that as the bristles pass the stop the kinetic energy is released and the bristles spring elastically forward and percussively strike the workpiece surface. A roughness of the workpiece surface is determined and the stop is positioned radially relative to the axis or the brush is positioned relative to the workpiece at a spacing in accordance with the determined roughness.

11 Claims, 2 Drawing Sheets

(56) References Cited

U.S. PATENT DOCUMENTS

| | | | | |
|---|---|---|---|---|
| 2007/0209126 | A1* | 9/2007 | Montabaur | A46B 13/001 15/23 |
| 2019/0224805 | A1 | 7/2019 | Montabaur | |
| 2020/0070249 | A1* | 3/2020 | Ozdoganlar | B08B 1/00 |
| 2023/0157504 | A1* | 5/2023 | Jia | A47L 11/24 15/4 |

* cited by examiner 16
1
17
4
B
3
8
5
7
2

METHOD OF TREATING A WORKPIECE

FIELD OF THE INVENTION

The invention relates to a method of treating a surface of a workpiece by a brush assembly with a rotatably drivable brush holder and a ring brush with a bristle ring with outwardly projecting bristles.

BACKGROUND OF THE INVENTION

With such a brush assembly, the rotating bristles are elastically deformed and store kinetic energy as a result of an adjustable stop or blocking element that dips into the rotating bristle ring, so that, after the bristles are released, they act upon the surface of the workpiece not only in a rotating manner but also percussively due to the release of the stored kinetic energy that occurs after the stop is passed.

A method having the above-described structure is described by way of example and in large part in the applicant's patent EP 1 834 733 [U.S. Pat. No. 9,554,642]. The brush assembly and the stop can create roughness depths on the surface of the processed workpiece that could previously only be achieved by sandblasting. In fact, roughness depths of more than 50 μm, particularly of more than 60 μm up to 100 μm and more are observed. The indicated roughness depths are referred to collectively as mean roughness values $R_a$ (as the arithmetic mean of the absolute values of profile deviations within a sampling length according to DIN 4764 and DIN ISO 1302). This has been found to be reliable in principle and is widely used in practice. In addition, EP 2 618 965 [U.S. Pat. No. 9,918,544] also of the current applicant, describes such a method in which the stop acts simultaneously as an abrasive body for the bristles. The stop is displaceable for this purpose, being designed to be displaced for example radially and/or tangentially. Eccentric displacement is also possible.

The prior art has proven to be fundamentally advantageous when it comes to roughing surfaces of a workpiece or removing coatings or rust from the surface. However, for the subsequent treating of the surface with a view to the application of paint or of a metal and/or plastic coating, etc., it is often necessary to reproducibly set the surface roughness to comply with certain specifications. This is not immediately possible using the approaches that have hitherto been described, or it must ultimately be performed manually. It is not possible to process large surfaces of workpieces in a reproducible manner in this way.

OBJECT OF THE INVENTION

The object of invention is to further develop such a method of treating a surface of a workpiece with a brush assembly in such a way that desired roughness depths of the surface can be set in a reproducible manner.

SUMMARY OF THE INVENTION

A surface of a workpiece is treated by rotating about an axis a brush having a multiplicity of radially projecting bristles with tips engaging a surface of a workpiece to be treated while positioning a stop nonrotatable with the brush in engagement with the bristles radially inward of the stop so as to rearwardly deflect the bristles prior to contact with the workpiece and thereby store kinetic energy in the bristles so that as the bristles pass the stop the kinetic energy is released and the bristles spring elastically forward and percussively strike the workpiece surface. According to the invention a roughness of the workpiece surface is determined and the stop is positioned radially relative to the axis or the brush is positioned relative to the workpiece at a spacing in accordance with the determined roughness. Thus according to the invention the stop and/or the ring brush is positioned as a function of the roughness of the surface of the workpiece.

According to the invention, the procedure is initially such that an adjustment of the stop and/or of the ring brush is performed in dependence upon the roughness of the surface of the workpiece. The invention proceeds here from the realization that a change in the radial position of the stop relative to a rotation axis of the rotatable brush holder holding the ring brush has a direct influence on the roughness of the surface of the workpiece. After all, a change in the radial position of the stop relative to the axis of the ring brush ultimately changes the kinetic energy with which the bristles meet the surface of the workpiece to be processed. The rule of thumb that generally applies here is that the shorter the radial spacing of the stop to the axis of the ring brush in question, the greater the kinetic energy. This is because as the radially spacing of the stop radially decreases there is increased and intensified deformation of the bristles and consequently increased kinetic energy with which the bristles act on the surface of the workpiece.

These fundamental relationships have been studied by Prof. Robert J. Stango et al and published in several publications. Reference is made to the two publications: "Surface preparation of ship-construction steel/(ABS-A) via bristle blasting process," NACE Corrosion Conference & Expo 2010, Paper no. 10385, and "Evaluation of bristle blasting process for surface preparation of ship-construction steel" (Nace Corrosion Conference & Expo 2012, paper no. C2012-0001442). According to a preferred embodiment, the stop is designed to be radially adjustable for the most part relative to said axis of the rotating ring brush for this purpose and/or can be positioned radially relative to the said axis. Similarly, the ring brush can also be placed against the surface and/or perform an axial movement.

The roughness of the surface of the workpiece can, in turn, be detected by contacting and/or contact-free means. In fact, the surface of the workpiece is detected in this context on the basis of the mean roughness $R_A$. This is the arithmetic mean of the respectively measured absolute deviation of the individual measuring point from a center line. The specifications are made in accordance with DIN ISO 1302, as described in the introduction. In principle, the so-called maximum roughness profile height $R_z$ can also be measured and evaluated. This is the sum of the height of a largest profile peak $R_p$ and the depth of the largest profile valley $R_v$ within a single measured length. As a vertical distance from the highest to the lowest profile point, $R_z$ is a measure of the scatter range of the roughness ordinate values. As a matter of principle, though, there are different ways to detect the roughness or coarseness of the surface of the workpiece in a contacting and/or contact-free manner.

Categorically speaking, it is possible to proceed by determining the roughness or coarseness of the surface of the workpiece that has not yet been processed by the ring brush or bristles and adjusting the stop and/or the ring brush accordingly as a function thereof. Generally, however, the procedure followed is to detect the roughness of the processed surface. This enables the stop to be moved accordingly, particularly in dependence on the measured values for the roughness or coarseness of the processed surface of the workpiece. For this purpose, the roughness of the processed surface in question is converted with a controller into actuating movements of the stop and/or ring brush depending on the roughness profile desired for the surface. In other words, the values for the roughness or coarseness of the surface, specifically the mean roughness $R_a$ in the exemplary case or the arithmetic mean value $R_a$, is used as an input variable for controlling the controller. Depending on the desired roughness or coarseness and, specifically, the arithmetic mean roughness $R_a$, the stop and/or the ring brush can now be positioned accordingly. For example, if the mean roughness $R_a$ is to be increased, then the stop will be moved radially inward by the controller, for example. Conversely, a radially outer of the stop is possible and conceivable for a reduced mean roughness $R_a$.

In addition to such a basic control, feedback control is also possible. In that case, an actual value for the mean roughness $R_{aActual}$ is compared in the exemplary case with a set value of the mean roughness $R_{aTarget}$ stored and predetermined in the regulating unit. Depending on the deviations of the measured actual roughness $R_{aActual}$ from the set-point $R_{aTarget}$, the stop is then positioned in the manner of a closed-loop control. Consequently, the roughness of the surface of the workpiece can be adapted to the actual requirements by for example taking a subsequent application of paint, a plastic coating, a metal coating, etc., into account.

The roughness of the surface can be detected tactilely by a stylus that scans the surface mechanically. Generally, however, a contactless approach is taken here. The roughness of the surface can then be scanned by sound waves, for example, with electromagnetic waves being preferably used. Scanning with electromagnetic waves and particularly with a laser has proven to be especially favorable and advantageous in this respect.

In fact, in most cases the surface of the workpiece to be processed or the already processed surface of the workpiece in question is scanned in the manner of a preferably two-dimensional triangulation method. Here, the laser beam is usually projected as an extremely thin line of light at a defined angle onto the surface to be measured. The originally straight light line of the laser is distorted by the roughness or coarseness of the processed surface in the exemplary case proportionally to the angle of incidence of the laser on the surface. With an optical recording device, for example, a close-up lens in conjunction with a camera, an image of this projected laser line can now be recorded. The surface profile can now be calculated directly from the deflection of the light line, this method being particularly suitable for determining the mean roughness $R_a$. In addition, the maximum roughness profile height $R_z$ can be determined in this way. Details of such a conceivable triangulation method are described in EP 0 585 893 for example. In addition, reference is made to a publication of the company "Amepa" at "amepa.de" on the topic of "SRM—Online roughness measurement."

Especially preferably, the invention does not rely solely on the possibility that the stop can typically be positioned in the radial direction relative to the ring brush. Instead, the ring brush can be advantageously moved together with the stop in relation to its radial spacing and/or parallel relative to the surface of the workpiece, i.e. in the axial direction. The contact pressure of the ring brush on the surface to be processed can ultimately be varied by changing the spacing of the ring brush including stop relative to the surface of the workpiece. The rule of thumb that applies here is that the shorter the radial spacing between the ring brush relative to the surface of the workpiece is set, the greater the contact pressure of the rotating bristles on the surface in question and the greater the roughness $R_a$ or $R_z$ generated in this way on the surface. This is expressed in the above-mentioned studies by Prof. J. Stango, to which reference is made again. A parallel displacement or axial displacement of the ring brush relative to the surface of the workpiece also has the effect that the roughness profile generated on the surface of the workpiece is especially homogeneous and, in particular, has no preferred directions. The invention also relates to a brush assembly and to a rotary brush tool, both of which work advantageously according to the described method of the purpose of treating the surface of the workpiece and are equipped with an appropriately designed brush assembly.

A novel method of treating surfaces of workpieces is thus provided and described. This method is characterized in that a reproducible roughness or coarseness can be imparted to the surface of the workpiece in question. This enables the surface finish of the workpiece to be optimally adapted to optional downstream treating or coating. This was previously not possible in this degree of consistency and specificity. Furthermore, automatic treating of the surface of the relevant workpiece in the manner of control with or without feedback is also made possible, as was described above in detail. As a result, large surfaces of any desired size can be roughened in a reproducible manner. Herein lie the fundamental advantages.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
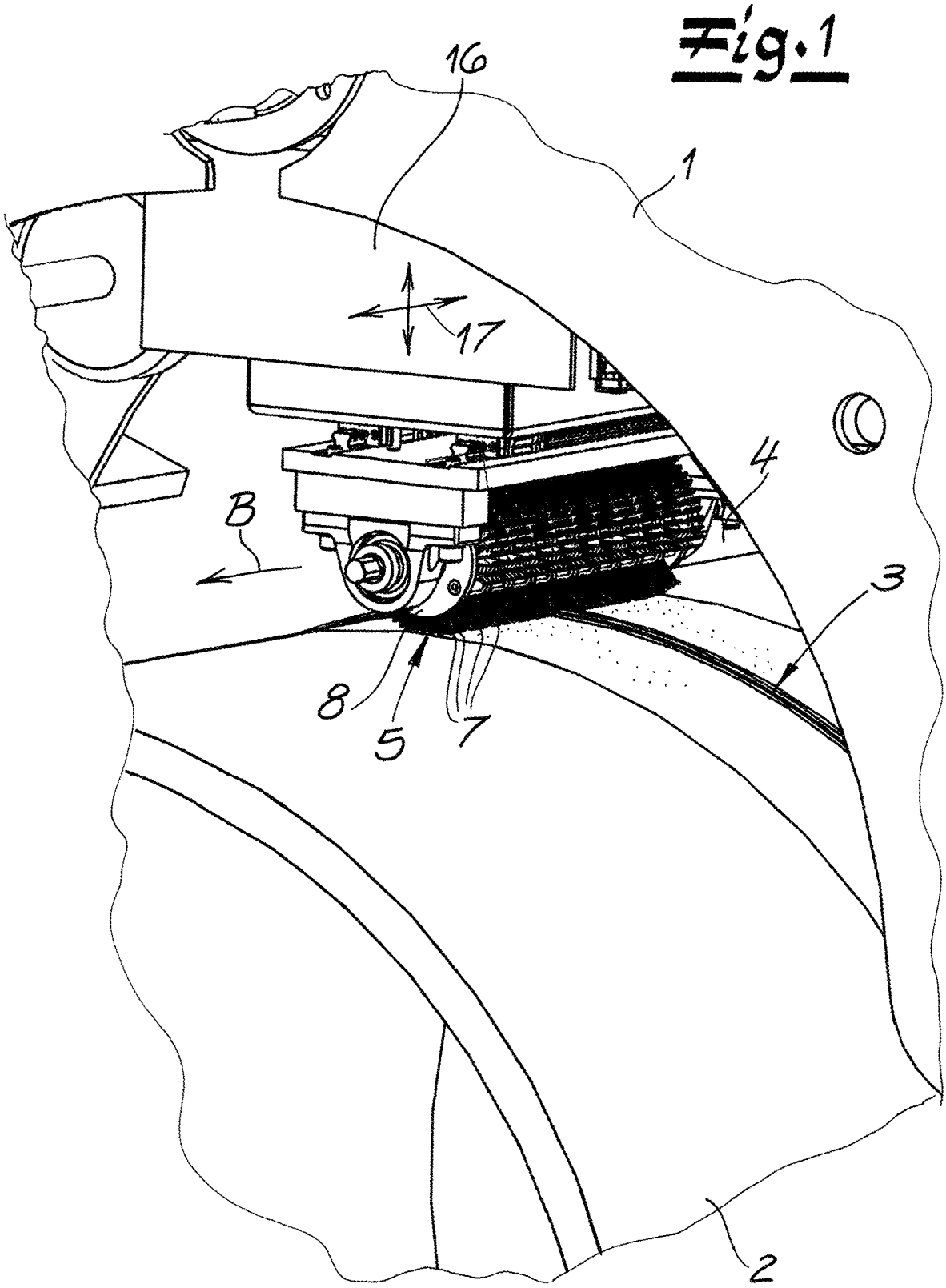
FIG. 1 is a perspective view of a rotary brush tool together with brush assembly and associated ring brush according to the invention, the latter being driven by the former.

As seen in FIG. 1 a rotary brush tool has a part-cylindrical frame 1 that can fit around a workpiece 2 to be processed. According to this embodiment, and without limitation thereto, the workpiece 2 is a pipe or conduit made of individual pipes that are butted and welded together. The pipes are connected to one other by a butt weld 3 visible in FIG. 1. In the exemplary case, in order to protect the weld seam 3 and, in general, the region of the interconnection of the pipes from corrosion, the surface of the workpiece 2 in the vicinity of the weld seam 3 is processed by the rotary brush tool described in detail below. Subsequent to this treating, a protective coating can be applied to the pipe or workpiece 2 in this region.

As will readily be understood, the rotary brush tool to be described in greater detail below is not only suitable for treating surfaces on curved workpieces 2 such as the pipe or conduit shown in FIG. 1. Rather, the rotary brush tool can be used just as well for treating a flat workpiece surface, although this is not shown in detail. According to this embodiment, the rotary brush tool is carried by the machine frame 1. In addition, the machine frame 1 can be set up such that it surrounds the workpiece or pipe 2, in this case like a claw. Moreover, it is conceivable for the machine frame 1 to rotate about an axis of the pipe, thereby enabling the pipe in question to be processed in the region of the weld seam 3 as a whole and over its entire circumference by the rotary brush tool.

Specifically, the rotary brush tool has a drive 4 only partially visible in FIG. 1 and that rotates a brush assembly 5 as an essential component of the rotary brush tool. The assembly 5 is equipped for this purpose with a ring brush 6, 7 best seen in FIG. 2. The ring brush 6, 7 is composed of a core sleeve 6 and bristles 7 that are anchored in the core sleeve 6 and project radially outward therefrom to form an annular brush. The core sleeve 6 can be made of a woven plastic strip of polyamide, for example. According to this embodiment shown in FIG. 2, but without limitation thereto, the bristles 7 are steel bristles anchored in the core sleeve 6 and that have bristle tips 7' that are bent forward. Of course, this is only for the sake of example.

The ring brush 6, 7 is received in a rotatably drivable brush holder 8 best seen in FIG. 1. The brush holder 8 can be designed as described in the applicant's patent DE 43 26 793 [U.S. Pat. No. 5,525,315]. In principle, other brush holders 8 are also conceivable here, such as those presented in detail in applicant's patent application WO 2017/220338 [US 2019/0224805]. The brush holder 8 for receiving the ring brush 6, 7 can be constructed from multiple parts as described in the above-mentioned publications. In principle, however, it is also conceivable for the ring brush 6, 7 to be securely connected to the brush holder 8. In general, however, a multi-part brush holder 8 will be used according to the publications mentioned above, not least in order to enable the ring brush 6, 7 to be replaced as need and wear dictate.

An adjustable stop 9 is also of particular importance for the rotary brush tool or the brush assembly 5. In fact, the stop 9 is connected to an arm 10 and can be positioned thereby with respect to its radial spacing A to the axis Z of the ring brush 6, 7 shown in FIG. 2. This is indicated by a corresponding arrow in FIG. 2. The movement of the stop 9 with respect to its position relative to the bristles 7 now takes place as a function of the roughness or coarseness of the surface of the workpiece 2. That is, the stop 9 is positioned depending on the roughness or coarseness of the surface of the workpiece 9. The criterion used for positioning the stop 9 is the already processed surface of the workpiece 2, i.e. the region of the surface of the workpiece 2 downstream of the rotary brush tool or the brush assembly 5 in the treatment direction indicated by arrow B in FIG. 2. In principle, the part of the surface of the workpiece 2 upstream in the treatment direction B can also be used for positioning the stop 9. According to this embodiment however and preferably, the region of the surface of the workpiece 2 downstream in the treatment direction B and has already been processed is examined for its roughness or coarseness, and the stop 9 is positioned on that basis.

Thus as also described in above-cited commonly owned U.S. Pat. No. 9,554,642 (which is incorporated herewith by reference) the brush 5 is rotated on the frame or housing 1 about the axis Z in one direction at a predetermined angular speed such that the bent-forward tips 7' of the steel-wire bristles 7 extending generally radially of the axis Z define a circular orbit centered on the axis Z. These tips 7' engage a surface of the workpiece 2 radially at a location to abrade the surface at this location. The stop or blocking element 9 nonrotatable relative to the brush 5 and radially inside the orbit and rearward in the brush-rotation direction from the abrading location temporarily slows angular movement of the bristle tips 7' such that when released they snap back to engage the workpiece surface at a greater peripheral speed than the angular speed and with the tips 7' striking and hammering the workpiece surface generally perpendicularly at the abrading location.

According to this embodiment, a roughness detector 11, 12, 13 is provided downstream of the brush assembly 5 or the rotary brush tool in the treatment direction B in order to enable detection of the roughness or coarseness of the already processed surface of the workpiece 2. For this purpose, the roughness detector 11, 12, 13 has a laser 11, a distance sensor 12, and a camera 13, for example a CCD camera 13. The laser 11, the distance sensor 12, and also the CCD camera 13 are all connected to a controller 14 that operates with or without feedback and is responsible for controlling and detecting the roughness measurement values $R_a$, that is, for the sake of example and without limitation, the mean roughness $R_a$ in accordance with the introductory explanations.

In fact, the laser 11 is directed onto the surface of the workpiece 2 at a defined angle $\alpha$ and projects an extremely thin line of light onto the surface in question. This line of light is now examined for distortions caused by the surface texture by the high-resolution camera 13, which may be equipped with an unillustrated lens. The surface profile in question can be calculated directly from the deflection of the line of light relative to its straight course. The image of this projected and, due to the surface texture, distorted line of light of the laser 11 is detected by the camera 13, and this image data is converted by the controller 14 connected to the camera 13 to the desired roughness values $R_a$, or the roughness values in question $R_a$ are derived therefrom.

The additional distance sensor 12 is used primarily for control purposes and ensures that, in case of any deviations of the surface of the workpiece 2 from a plane, bulges, etc., a perfect and sharp image of the straight line of light outputted by the laser 11 is still present on the surface of the workpiece 2 and can be examined for deviations resulting from the surface texture. Optionally, the spacing of the entire roughness detector 11, 12, 13 to the surface of the workpiece 2 can be changed appropriately as indicated by a double arrow in FIG. 2. A change in the spacing is made in accordance with the measured values of the distance sensor 12.

Figure 2:
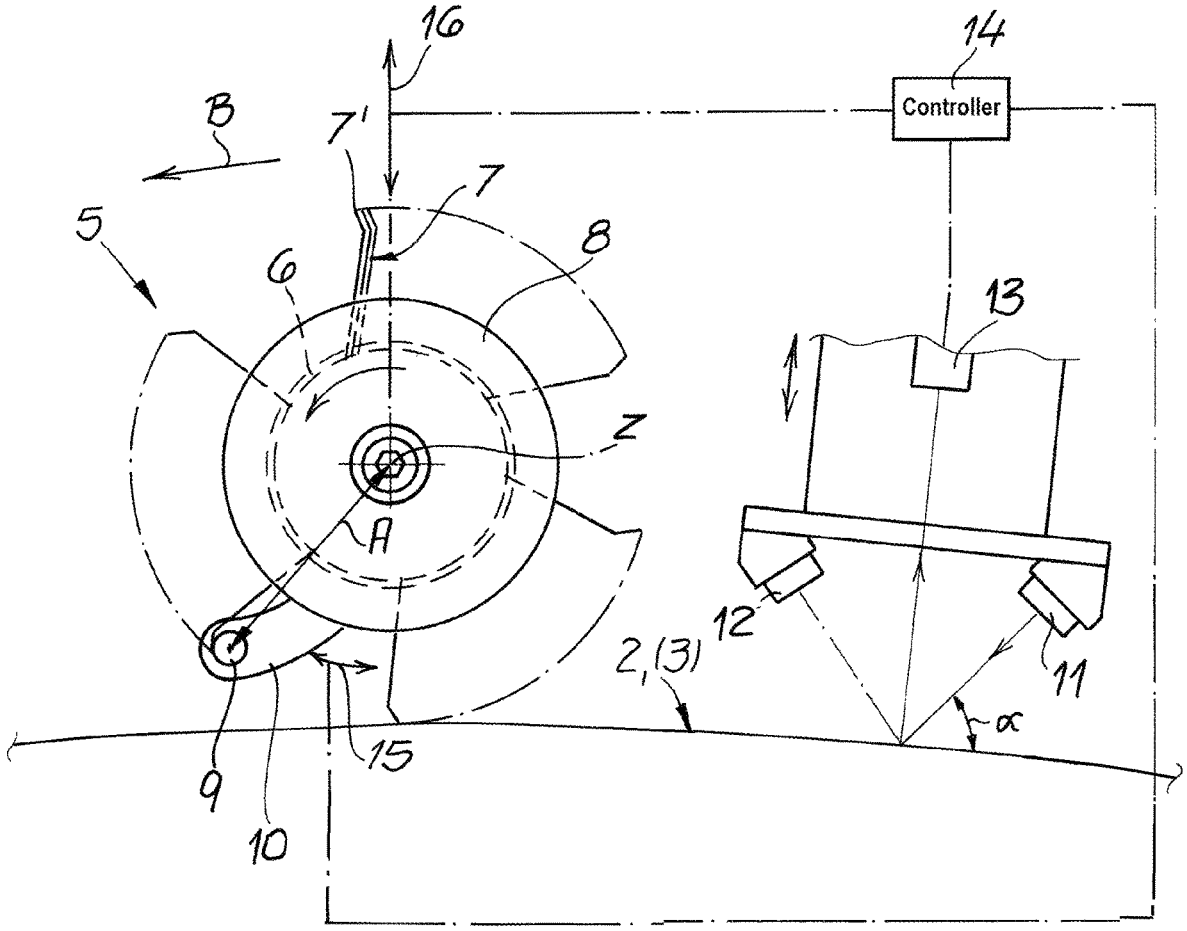
FIG. 2 is a schematic side view of the system of FIG. 1.

As already explained, the stop 9 can be positioned radially for the most part relative to the axis Z of the ring brush 6, 7. A stop drive 15, which is merely indicated in FIG. 2, may provide for corresponding actuating movements of the stop 9 or of the arm 10 supporting the stop 9. For this purpose, the stop drive 15 acts on the arm 10 that is mounted so as to be rotatable about the axis Z coaxially with the ring brush 6, 7. This is obviously only for the sake of example and by no means limiting. In any case, the radial spacing A of the stop 9 to the axis Z of the ring brush 6, 7 can be varied by the stop drive 15, as indicated in FIG. 2.

In addition to the drive 4 for the ring brush 6, 7 and the stop drive 15 for the stop 9, another ring brush drive 16 is also provided. The ring brush drive 16 can urge the entire ring brush 6, 7 including the stop 9 and the arm 10 toward the surface of the workpiece 2 and can lift it off same, thereby applying a load perpendicular to the surface of the workpiece 2, as indicated by a corresponding double arrow 17 in FIG. 1. The roughness depth of the surface of the workpiece 2 can thus also be influenced, as already explained above. For this purpose, the stop drive 15 on the one hand and the ring brush drive 16 on the other hand are each connected to the control unit 14 as indicated by corresponding electrical connecting lines in FIG. 2. In principle, the ring brush drive 16 can also ensure that the ring brush 6, 7 is displaced not only relative to its spacing from the surface of the workpiece 2, but alternatively or additionally also undergoes a change in position parallel to the surface of the workpiece in question 2. That is, the ring brush drive 16 may also be responsible for an axial movement of the ring brush 6, 7, as indicated by the double arrow in FIG. 1. Applied to FIG. 2, this means that the ring brush drive 16 also moves the ring brush 6, 7 perpendicular to the drawing plane or parallel to the axis Z.

In the context of the invention, the stop 9 is moved by the stop drive 15 and/or the ring brush 6, 7 along with stop 9 and with the arm 10 are displaced collectively by the ring brush drive 16 in dependence upon roughness values $R_a$ of the surface of the workpiece that are detected by the roughness detector 11, 12, 13. This can be performed by the controller 14 with or without feedback. For this purpose, the roughness values in question $R_{aActual}$ are detected in the treatment direction B downstream of the ring brush 6, 7 by the roughness detector 11, 12, 13 and transmitted to the controller 14. In the controller 14, these actual values $R_{aActual}$ are now compared with the set-point values $R_{aTarget}$ stored therein. Depending on the deviation of the actual values $R_{aActual}$ from the target values $R_{aTarget}$, the stop 9 is now moved by the stop drive 15 and/or the entire ring brush 6, 7 by the ring-brush drive 16 in order to effect a convergence between the target values $R_{aTarget}$ and the actual values $R_{aActual}$ in the manner of a feedback control.

We claim:

1. A method comprising the steps of:

rotating about an axis in a direction a brush having a multiplicity of radially projecting bristles with tips engaging a surface of a workpiece to be treated;

positioning a stop nonrotatable with the rotating brush in engagement with the bristles radially inward of the stop so as to rearwardly deflect the bristles prior to contact with the workpiece and thereby store kinetic energy in the bristles, whereby as the bristles pass the stop the kinetic energy is released and the bristles spring elastically forward, percussively strike the workpiece surface, and modify a roughness of the surface;

determining roughness of the workpiece surface of the workpiece immediately downstream in the direction from where the bristles strike the surface;

positioning the stop radially relative to the axis or the brush relative to the workpiece at a spacing in accordance with the determined roughness downstream of where the bristles strike the surface such that the workpiece surface has a predetermined roughness after being struck by the bristles.

2. The method according to claim 1, the stop is positioned radially for the most part relative to the axis at a radial spacing that is changed according to the determined roughness.

3. The method according to claim 1 wherein roughness of the surface of the workpiece is detected by contact-free means.

4. The method according to claim 1, wherein the roughness of the surface of the workpiece is detected and converted by a controller into actuating movements of the stop or of the ring brush depending on a desired roughness profile of the surface.

5. The method according to claim 1, wherein roughness of the surface is determined by scanning the surface of the workpiece in a tactile manner with a stylus or in a contactless manner by a sound source or a source for electromagnetic waves.

6. The method according to claim 1, further comprising the step of not only positioning the stop relative to the ring brush, but also displacing the ring brush together with the stop in relation to its radial spacing or parallel to the surface of the workpiece.

7. The method according to claim 1, further comprising the step of:

moving the brush and workpiece jointly axially relative to the surface.

8. An apparatus comprising:

a brush rotatable in a direction about an axis and having a multiplicity of radially projecting bristles with tips engageable with a surface of a workpiece to be treated;

a stop nonrotatable with the brush and in engagement with the bristles radially inward of the stop so as to rearwardly deflect the bristles prior to contact with the workpiece and thereby store kinetic energy in the bristles, whereby as the bristles pass the stop the kinetic energy is released and the bristles spring elastically forward and percussively strike the workpiece surface; and control means for determining a roughness of the workpiece offset downstream the direction from where the bristles strike the surface and positioning the stop radially relative to the axis or the brush relative to the workpiece at a spacing in accordance with the determined roughness to create a predetermined uniform roughness where the bristles strike the workpiece.

9. The apparatus according to claim 8, wherein the control means displaces the brush and workpiece relative to each other in a predetermined direction and roughness is detected by scanning the surface at a location downstream in the predetermined direction from the location where the brush tips engage the surface such that a treated portion of the workpiece is scanned.

10. A method of treating a surface of a workpiece using a brush assembly, the method comprising the steps of:

rotating in a direction about an axis a brush having a multiplicity of radially projecting bristles with tips engaging a surface of a workpiece to be treated;

positioning a stop nonrotatable with the brush in engagement with the bristles radially inward of the axis of the stop so as to deflect the bristles rearward relative to the direction prior to contact with the workpiece and thereby store kinetic energy in the bristles, whereby as the bristles pass the stop the kinetic energy is released and the bristles spring elastically forward and percussively strike the workpiece surface;

determining a roughness of the workpiece surface by scanning the surface downstream relative to where the bristles strike the surface in a contactless manner with a laser; and positioning the stop radially relative to the axis or the brush relative to the workpiece at a spacing in accordance with the determined roughness.

11. The method according to claim 10, wherein the surface of the workpiece is scanned using a two- or three-dimensional triangulation method.

* * * * *